US008141371B1

(12) United States Patent
Habarou et al.

(10) Patent No.: US 8,141,371 B1
(45) Date of Patent: Mar. 27, 2012

(54) GAS TURBINE COMBUSTION CHAMBER MADE OF CMC MATERIAL AND SUBDIVIDED INTO SECTORS

(75) Inventors: Georges Habarou, Le Bouscat (FR); Pierre Camy, Saint Medard en Jalles (FR); Benoit Carrere, Le Taillan Medoc (FR); Eric Bouillon, Le Haillan (FR)

(73) Assignee: Snecma Propulsion Solide, Le Haillan (FR)

( * ) Notice: Subject to any disclaimer, the term of this patent is extended or adjusted under 35 U.S.C. 154(b) by 567 days.

(21) Appl. No.: 12/416,422

(22) Filed: Apr. 1, 2009

(30) Foreign Application Priority Data

Apr. 3, 2008 (FR) ..... 08 52232

(51) Int. Cl.
*F23R 3/50* (2006.01)

(52) U.S. Cl. ..... 60/804; 60/753; 60/800

(58) Field of Classification Search ..... 60/753, 60/800, 752, 804
See application file for complete search history.

(56) References Cited

U.S. PATENT DOCUMENTS

| | | | | |
|---|---|---|---|---|
| 3,956,886 | A * | 5/1976 | Sedgwick | 60/753 |
| 6,610,385 | B2 * | 8/2003 | Cairo | 60/753 |
| 6,708,495 | B2 * | 3/2004 | Calvez et al. | 60/753 |
| 2007/0186558 | A1 * | 8/2007 | De Sousa et al. | 60/804 |

FOREIGN PATENT DOCUMENTS

| | | | |
|---|---|---|---|
| EP | 0706009 | A2 | 4/1996 |
| EP | 1635118 | A | 3/2006 |
| EP | 1801502 | A | 6/2007 |
| GB | 1570875 | A | 7/1980 |
| GB | 2432902 | A | 6/2007 |
| JP | 56059131 | A | 5/1981 |
| WO | WO 99/48837 | | 9/1999 |

* cited by examiner

*Primary Examiner* — Ted Kim
(74) *Attorney, Agent, or Firm* — Weingarten, Schurgin, Gagnebin & Lebovici LLP

(57) ABSTRACT

An assembled annular combustion chamber comprises an annular inner wall and an annular outer wall made of ceramic matrix composite material together with a chamber end wall connected to the inner and outer walls and provided with orifices for receiving injectors. Elastically-deformable link parts connect the inner wall and the outer wall of the chamber to inner and outer casings that are made of metal. The assembly formed by the inner wall, the outer wall, and the combustion chamber end wall is subdivided circumferentially into adjacent chamber sectors, each sector being made as a single piece of ceramic composite material and comprising an inner wall sector, an outer wall sector, and a chamber end wall sector. The link parts connect the inner metal casing and the outer metal casing respectively to each inner wall sector of the combustion chamber and to each outer wall sector of the chamber. The chamber end wall sectors are in contact with a one-piece ring to which they are connected.

15 Claims, 5 Drawing Sheets

GAS TURBINE COMBUSTION CHAMBER MADE OF CMC MATERIAL AND SUBDIVIDED INTO SECTORS

BACKGROUND OF THE INVENTION

The invention relates to gas turbines and more particularly to the configuration and the assembly of an annular combustion chamber having walls made of ceramic matrix composite (CMC) materials. The fields of application of the invention comprise gas turbine aero-engines and industrial gas turbines.

Proposals have been made to use CMCs for making gas turbine combustion chamber walls because of the thermostructural properties of CMCs, i.e. because of their ability to conserve good mechanical properties at high temperatures. Higher combustion temperatures are sought in order to improve efficiency and reduce the emission of polluting species, in particular for gas turbine aero-engines, by reducing the flow rate of air used for cooling the walls. The combustion chamber is mounted between inner and outer metal casings by means of link elements that are flexible, i.e. elements that are elastically deformable, thus making it possible to absorb the differential dimensional variations of thermal origin that occur between metal portions and CMC portions. Reference can be made in particular to documents U.S. Pat. No. 6,708,495, U.S. Pat. No. 7,237,387, U.S. Pat. No. 7,237,388, and U.S. Pat. No. 7,234,306.

CMC materials are constituted by refractory fiber reinforcement, e.g. made of carbon fibers or of ceramic fibers, which reinforcement is densified by a ceramic matrix. In order to make a CMC part of complex shape, a fiber preform is prepared of shape that is close to the shape of the part that is to be made, and then the preform is densified. Densification may be performed by a liquid process or by a gas process, or by a combination of both. The liquid process consists in impregnating the preform with a liquid composition that contains a precursor for the ceramic matrix that is to be made, the precursor typically being a resin in solution, and then pyrolytic heat treatment is performed after the resin has been cured. The gas process is chemical vapor infiltration (CVI), which consists in placing the preform in an oven into which a reaction gas phase is introduced to diffuse within the preform and, under predetermined conditions, in particular of temperature and pressure, to form a solid ceramic deposit on the fibers by decomposition of a ceramic precursor contained in the gas phase or by a reaction occurring between components of the gas phase.

Whatever the densification process used, tooling is required to hold the preform in the desired shape, at least during an initial stage of densification for consolidating the preform.

Making combustion chamber walls for a gas turbine requires tooling that is complex in shape. Furthermore, when performing densification by CVI, preforms can occupy a large amount of space in a densification oven, and it is highly desirable to optimize the way in which the oven is loaded.

Document EP 1 635 118 proposes using CMC tiles to make a chamber wall that is exposed to hot gas, which tiles are supported by a support structure that is spaced apart from the chamber wall. The tiles are formed with tabs that extend into the space between the chamber wall and the support structure and that extend through the support structure so as to be connected thereto on the outside. The connections are rigid and occupy significant volume outside the support structure. In addition, the presence of an additional casing is required in order to provide sealing.

Document GB 1 570 875 shows an annular combustion chamber made of ceramic material that is subdivided circumferentially into sectors, each incorporating an inner wall sector, an outer wall sector, and a chamber end wall sector interconnecting them. The combustion chamber is supported radially by resilient elements fastened to an outer metal casing and merely bearing against the outer faces of the chamber sectors, and it bears axially against other resilient elements. Such an assembly does not guarantee that the sectors are maintained in a constant axial position, in particular when the applied stresses are high, as happens in the combustion chambers of aviation turbines.

OBJECT AND SUMMARY OF THE INVENTION

An object of the invention is to remedy the above-mentioned drawbacks and for this purpose the invention provides an annular combustion chamber assembly for a gas turbine, the assembly comprising: an inner metal casing; an outer metal casing; an annular combustion chamber mounted between the inner and outer casings and comprising an annular inner wall and an annular outer wall of ceramic material together with a chamber end wall connected to the inner and outer walls and provided with orifices for receiving injectors; and elastically-deformable link parts supporting the combustion chamber between the inner metal casing and the outer metal casing; the assembly formed by the inner wall, the outer wall, and the end wall of the combustion chamber being subdivided circumferentially into adjacent chamber sectors, each comprising an inner wall sector, an outer wall sector, and a chamber end sector interconnecting the outer and inner wall sectors, in which assembly each chamber sector is made of a single piece of ceramic composite material, elastically-deformable link parts connect the inner metal casing and the outer metal casing respectively to each inner wall sector of the combustion chamber and to each outer wall sector of the chamber, and a one-piece ring is also provided in contact with the chamber end wall sectors and to which the chamber sectors are connected.

Subdividing the combustion chamber into sectors enables the dimensions of the parts that are to be made to be limited and also limits the complexity of the shapes thereof, thereby significantly reducing the costs of fabrication, while incorporating the chamber end wall with the inner and outer walls. Furthermore, the differential variations in dimensions between the metal casings and the CMC combustion chamber walls can be absorbed easily and effectively by the elastic deformation of the link elements placed in the gaps between the inner and outer chamber walls and the metal casings, in which gaps they are immersed in the stream of air flowing around the combustion chamber. The link elements also contribute to holding the chamber sectors relative to one another, in particular in the axial direction.

In addition, the chamber sectors are held together at the upstream end of the chamber by a one-piece ring.

The connections between the chamber sectors and the ring may be provided by means of injector bowls. The ring may also carry inner and outer annular cowls that are situated to extend the inner and outer walls of the combustion chamber upstream.

Advantageously, each link part has a first end fastened to the inner or outer metal casing and a second end fastened to an inner or outer wall sector of the combustion chamber. Each inner or outer combustion chamber wall sector may carry at least one tab to which the second end of a link part is fastened.

Advantageously, each tab of an inner or outer combustion chamber wall sector is made of ceramic matrix composite material and is incorporated in the sector during fabrication thereof. The tab then comprises fiber reinforcement that may extend continuously from fiber reinforcement of the inner or outer wall sector or that may be connected to said fiber reinforcement.

Preferably, a sealing gasket is interposed between adjacent chamber sectors. The sealing gasket may comprise a fiber structure made of refractory fibers, which fiber structure may optionally be densified at least in part by a ceramic matrix.

Inner and outer annular sealing lips may be fastened to the downstream end portion of the chamber on the outsides of the inner and outer chamber walls, in order to provide sealing at the interface between the combustion chamber and the turbine nozzle.

Advantageously, the sealing lips are fastened to tabs carried by the inner and outer wall sectors and serving to fasten the end portions of the link parts to the metal casings.

In a particular embodiment, the inner and outer chamber wall sectors are extended by end portions that are fastened on the outer faces of the inner and outer walls of a turbine nozzle disposed at the outlet from the combustion chamber.

The invention also provides a gas turbine aero-engine provided with a combustion chamber assembly as defined above.

BRIEF DESCRIPTION OF THE DRAWINGS

The invention can be better understood on reading the following description given by way of non-limiting indication with reference to the accompanying drawings, in which.

DETAILED DESCRIPTION OF AN EMBODIMENT

Embodiments of the invention are described below in the context of its application to a gas turbine airplane engine. Nevertheless, the invention is also applicable to gas turbine combustion chambers for other aero-engines or for industrial turbines.

Figure 1:
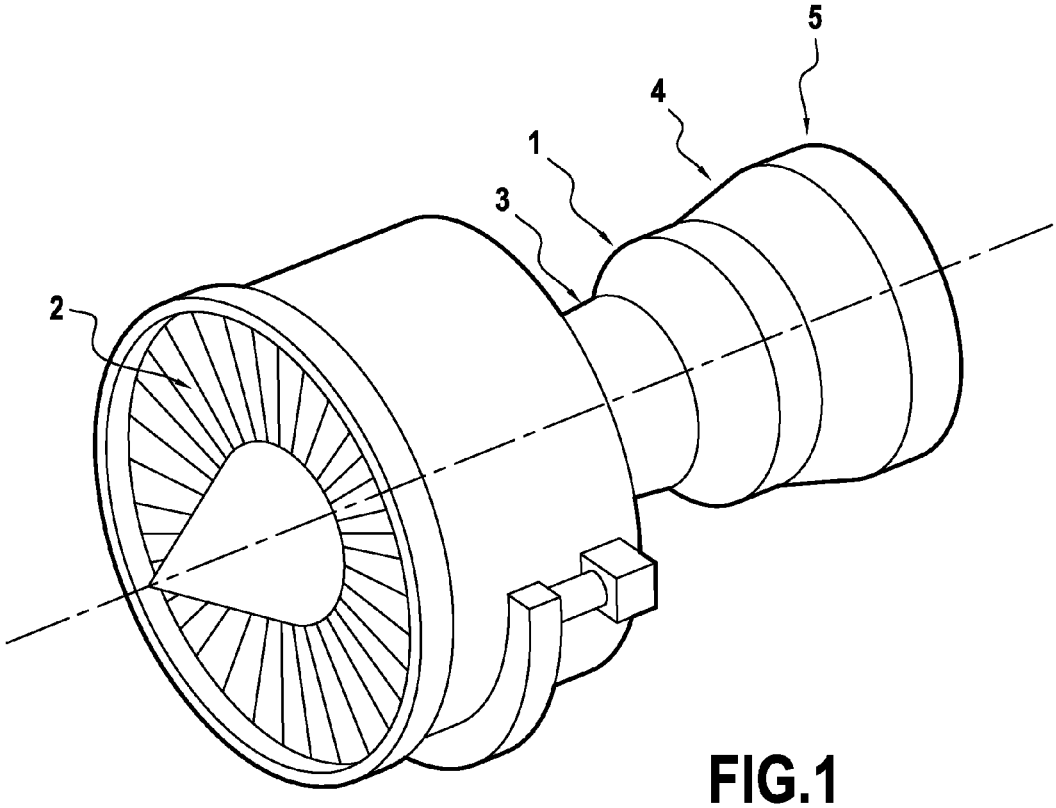
FIG. 1 is a highly diagrammatic view of a gas turbine airplane engine.

FIG. 1 is a highly diagrammatic view of a two-spool gas turbine airplane engine comprising, from upstream to downstream in the flow direction of the gas stream: a fan 2; a high pressure (HP) compressor 3; a combustion chamber 1; a high pressure (HP) turbine 4; and a low pressure (LP) turbine 5; the HP and LP turbines being connected to the HP compressor and to the fan by respective shafts.

Figure 2:
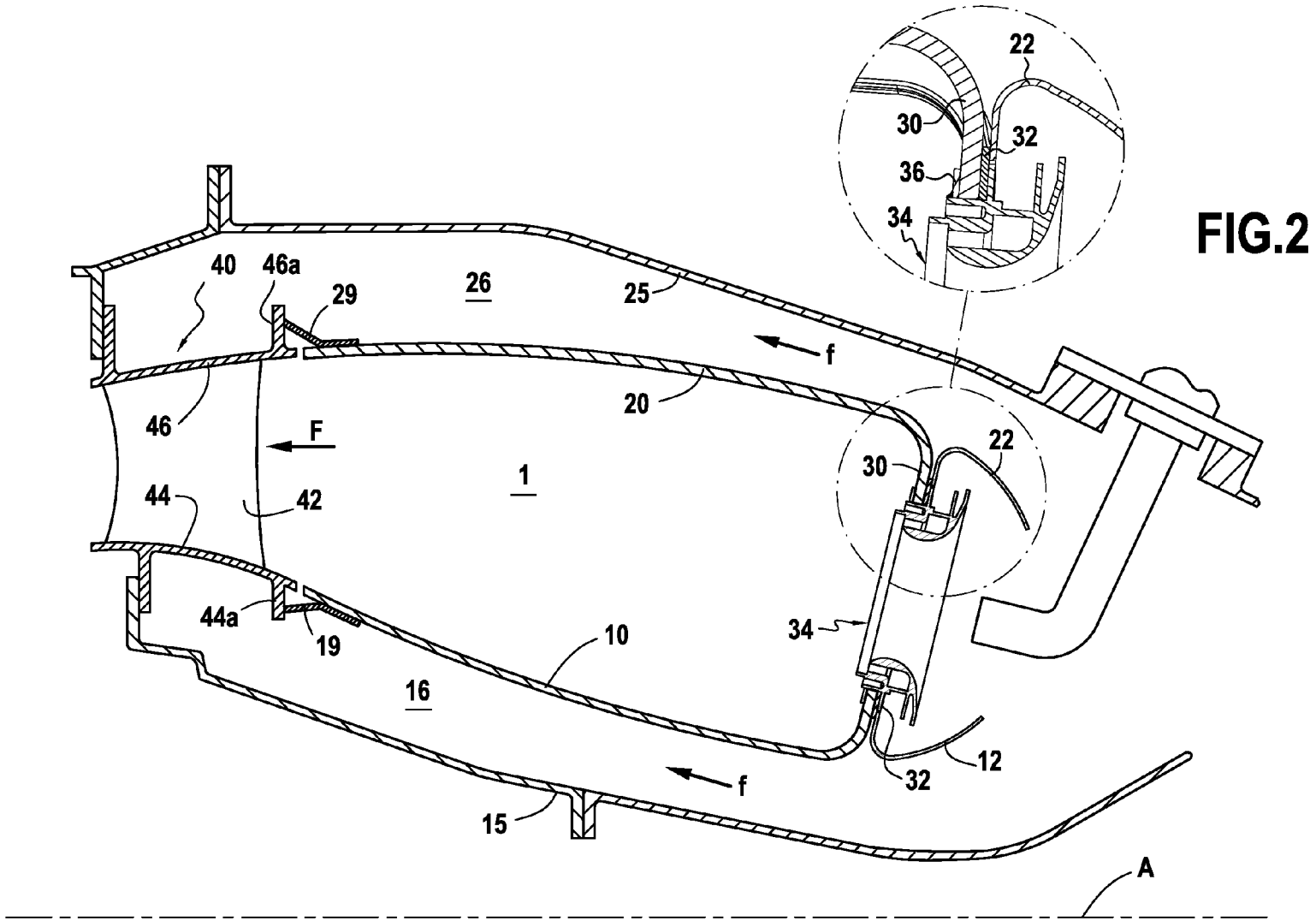
FIG. 2 is a highly diagrammatic section view with a detail on a larger scale showing a combustion chamber and its surroundings in a gas turbine engine such as that shown in FIG. 1, for example, and constituting an embodiment of the invention.

As shown very diagrammatically in FIG. 2, the combustion chamber 1 is of annular shape about an axis A and it is defined by an inner annular wall 10, an outer annular wall 20, and a chamber end wall 30. The end wall 30 defines the upstream end of the combustion chamber and presents openings that are distributed around the axis A for the purpose of receiving injectors that enable fuel and air to be injected into the combustion chamber. Beyond the end wall 30, the inner and outer walls 10 and 20 are extended by respective inner and outer annular cowls 12 and 22 that contribute to channeling air that flows around the combustion chamber.

At the downstream end of the combustion chamber, the outlet from the chamber is connected to the inlet of an HP turbine nozzle 40 that constitutes the inlet stage of the HP turbine. The nozzle 40 comprises a plurality of stationary vanes 42 that are made of metal or of composite material and that are angularly distributed around the axis A. The vanes 42 have their radial ends secured to respective inner and outer walls or platforms 44 and 46 that are likewise made of metal or of composite material and that present inner faces that define the flow duct through the nozzle for the gas stream coming from the combustion chamber (arrow F).

At the interface between the combustion chamber and the nozzle 40, sealing is provided by inner and outer annular lips 19 and 29 that are fastened to the outer faces of the walls 10, 20, and that have their ends bearing against annular flanges 44*a*, 46*a* that are secured to the walls 44, 46.

Figure 3:
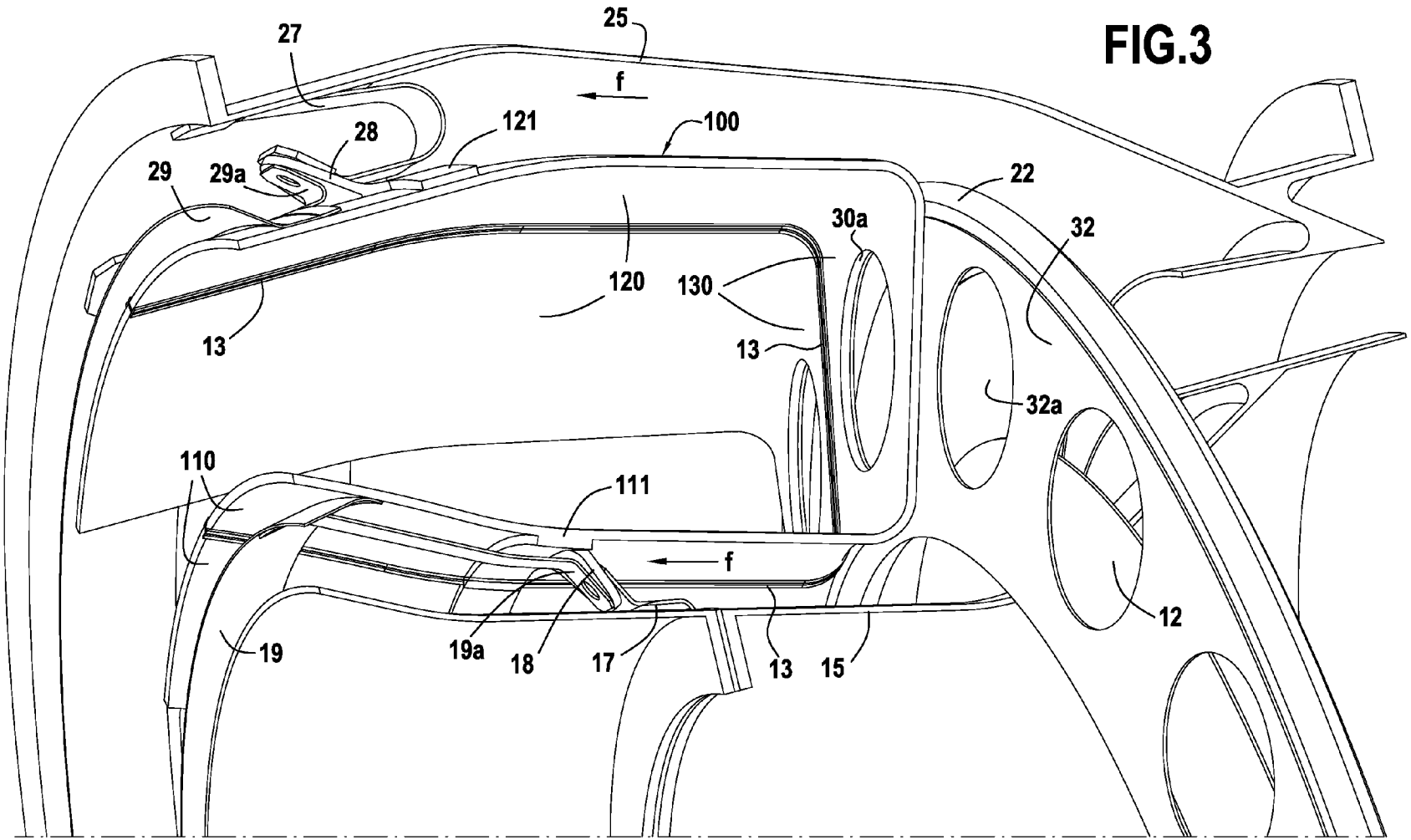
FIG. 3 is a partially cut-away perspective view seen from downstream showing the combustion chamber assembly of FIG. 2.
Figure 4:
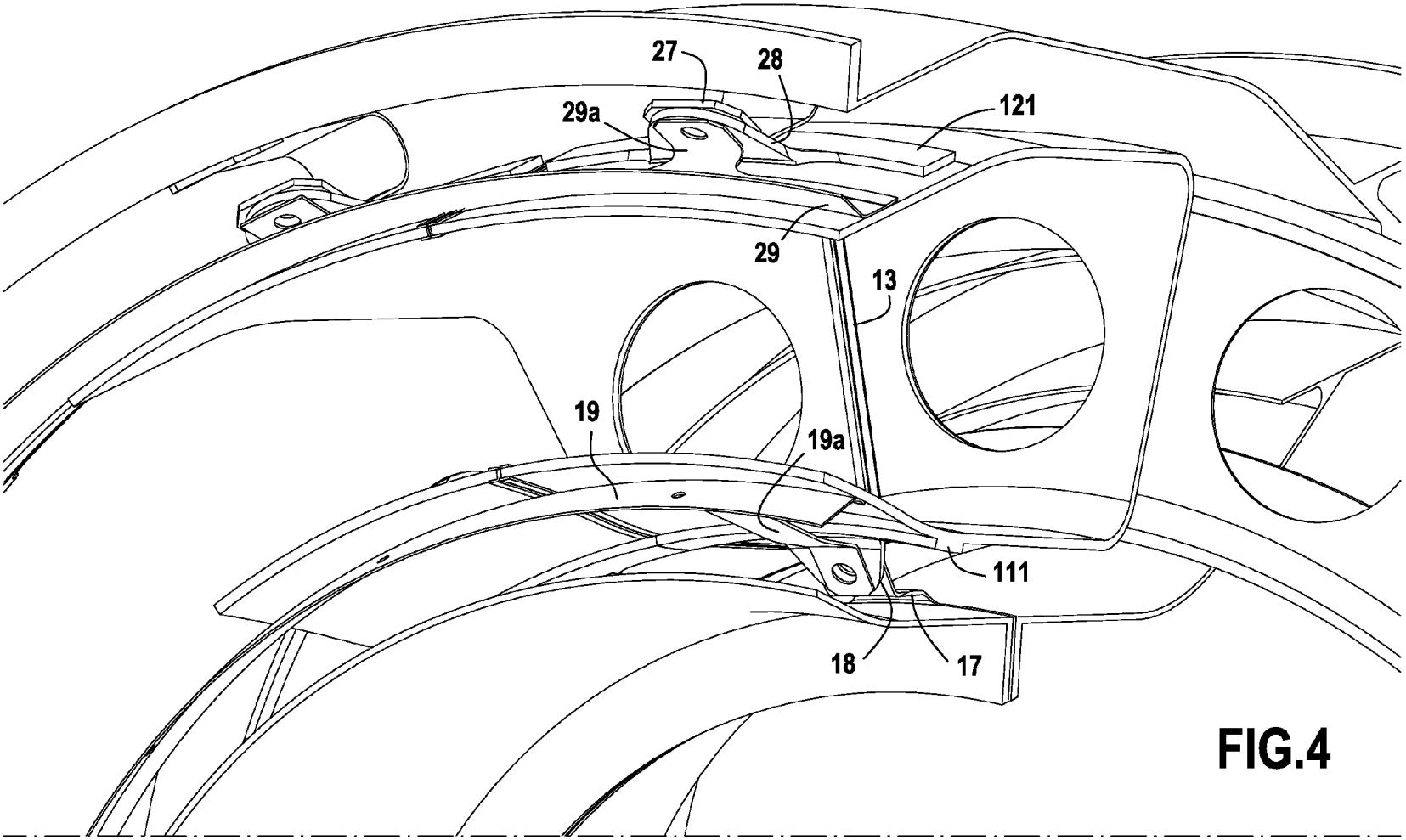
FIG. 4 is a fragmentary perspective view on a larger scale showing a portion of the combustion chamber of FIG. 3.

As shown in FIGS. 3 and 4, the combustion chamber is subdivided circumferentially into adjacent chamber sectors 100 having sealing gaskets 13 housed between one another. Each chamber sector is made as a single piece of ceramic matrix composite (CMC) material and comprises an inner wall sector 110, an outer wall sector 120, and a chamber end wall sector 130 interconnecting the sectors 110 and 120. The number of sectors 100 making up the entire combustion chamber depends on the ability to incorporate a plurality of injector housings when fabricating a sector and on the total number of injectors. For reasons associated with maintenance and with the suitability of the chamber for being repaired, each sector may incorporate one, two, or three injector housings, for example. In the example shown, the number of sectors is equal to the number of injectors, with each sector 100 having one opening 30*a* situated in the middle of the end wall sector 130.

The combustion chamber is supported between an inner metal casing 15 and an outer metal casing 25 by means of elastically-deformable link elements 17, 27. The link elements 17 connect the metal casing 15 to the inner wall 10, and the link elements 27 connect the metal casing 25 to the outer wall 20. The link elements 17, 27 extend in the spaces 16, 26 between the casing 15 and the inner wall 10, and between the casing 25 and the outer wall 20, which spaces convey the flow of cooling air (arrows f) flowing around the combustion chamber. The flexibility of the link elements, which are advantageously made of metal, but which could also be made of CMC, enables them to absorb the differential dimensional variations of thermal origin that occur between the CMC chamber walls and the metal casings.

Each chamber sector is connected to the casings 15 and 25 respectively by at least one link element 17 and at least one link element 27. In the example shown, only a single link element 17 is associated with each chamber sector 100, the element 17 being in the form of a metal strip folded into a U-shape and having one end fastened to a tab 18 situated on the outside of the wall sector 110 and its other end fastened to the metal casing 15. The ends of the link elements 17 may be fastened to the tabs 18 and to the casing 15 by bolting, screw-fastening, or riveting.

Similarly, in the example shown, only one link element 27 is associated with each chamber sector 100, the element 27 being in the form of a metal strip folded into a U-shape, having one end fastened to a tab 28 situated on the outside of the wall sector 120 and its other end fastened to the metal casing 25. The ends of the link elements 27 may be fastened to the tabs 28 and to the casing 25 by bolting, screw-fastening, or riveting.

The link elements 17, and likewise the link elements 27, are disposed in a circumferential row. The link elements 17, 27 thus contribute to holding the chamber sectors 100 relative to one another.

At the upstream end of the combustion chamber, the chamber sectors are held together mutually by fastening the end wall sectors 130 to a ring 32, e.g. made of metal, that presents openings 32*a* that correspond to the openings 30*a*. Fastening to the ring 32 may be achieved by mounting injector bowls 34 through the openings 30*a*, 32*a* as shown in FIG. 2 only, with this type of mounting in chamber end wall openings being well known. Each injector presents a rim that bears against the ring 32 and, on the inside of the chamber end wall, it is fastened at its periphery to a ring 36 by welding. In a variant, the end wall sector 130 could be fastened to the ring 32 by screw-fastening or by bolting.

The cowls 12, 22, which may be made of metal, may be fastened to inner and outer annular flanges of the ring 32, with fastening being performed by bolting or by screw-fastening, for example. In a variant, one of the cowls 12, 22 may be made integrally with the ring 32.

The sealing lips 19, 29 carry fastener tabs 19*a*, 29*a* that are advantageously fastened to the wall sectors 110, 120 by being mechanically connected to the tabs 18, 28, which tabs thus serve both to fasten the link elements 17, 27 and to fasten the lips 19, 29. Naturally, the sealing lips could be fastened in some other way to the wall sectors 110, 120, e.g. by being connected to tabs or other fastener members secured to the wall sectors and separate from the tabs 18, 28.

The tabs 18, 28 are made of CMC material and they may be fastened to the wall sectors 110, 120 by brazing or they may be incorporated in the sectors 100 during fabrication thereof.

The sectors 100 are made of a CMC material comprising fiber reinforcement densified with a ceramic matrix. The fibers of the fiber reinforcement may be made of carbon or of ceramic, and an interphase may be interposed between the reinforcing fibers and the ceramic matrix, e.g. an interphase of pyrolytic carbon (PyC) or of boron nitride (BN). The fiber reinforcement may be made by superposing fiber plies such as woven fabrics or sheets, or it may be made by three-dimensional weaving. The ceramic matrix may be made of silicon carbide or of some other ceramic carbide, nitride, or oxide, and it may also include one or more self-healing matrix phases, i.e. phases capable of healing cracks by taking on a pasty state at a certain temperature. Self-healing matrix CMC materials are described in U.S. Pat. No. 5,965,266, U.S. Pat. No. 6,291,058, and U.S. Pat. No. 6,068,930.

The interphase may be deposited on the reinforcing fibers by CVI. For ceramic matrix densification, it is possible to implement a CVI densification process or a liquid process, or indeed a reactive process (impregnation with a molten metal). In particular, it is possible to perform a first stage of densification for consolidating the fiber reinforcement while maintaining it in the desired shape by means of tooling, with densification subsequently being continued without supporting tooling. Ways of making CMC parts are well known.

The tabs 18, 28 may be incorporated when making the fiber reinforcement by locally spreading the reinforcement so that continuity then exists between the fiber reinforcement in the tabs and the fiber reinforcement in the chamber sectors. It may then be necessary to provide local extra thickness of reinforcement, giving rise to extra thickness 111, 121 of the wall of the sectors 110, 120, as shown in FIGS. 3 and 4. This extra thickness may be eliminated in part by machining in the gaps between the tabs 18, 28.

In a variant, the fiber reinforcement of the tabs 18, 28 may be added to the fiber reinforcement of the chamber sectors, e.g. by stitching or by any other textile method for implanting fibers, prior to proceeding with densification.

Sealing gaskets 13 are interposed between the facing longitudinal edges of the chamber sectors. By way of example, they may present an X-shaped section. The gaskets 13 may be made in the form of a fiber structure made of refractory fibers. It is possible to use a non-densified fiber structure made up of ceramic fibers, e.g. fibers of silicon carbide or of some other ceramic carbide, nitride, or oxide, the fiber structure being obtained by weaving or by braiding, for example. It is also possible to use a fiber structure that is made of refractory fibers (carbon or ceramic) and that is densified at least in part by a ceramic matrix obtained by CVI or by a liquid process.

Figure 6:
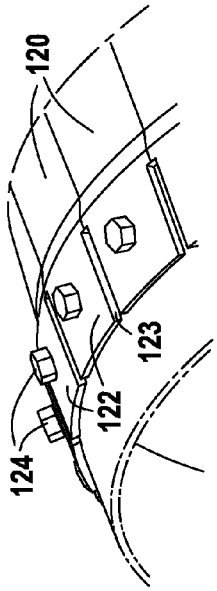
FIG. 6 is a perspective view showing a detail of the FIG. 5 combustion chamber assembly.
Figure 5:
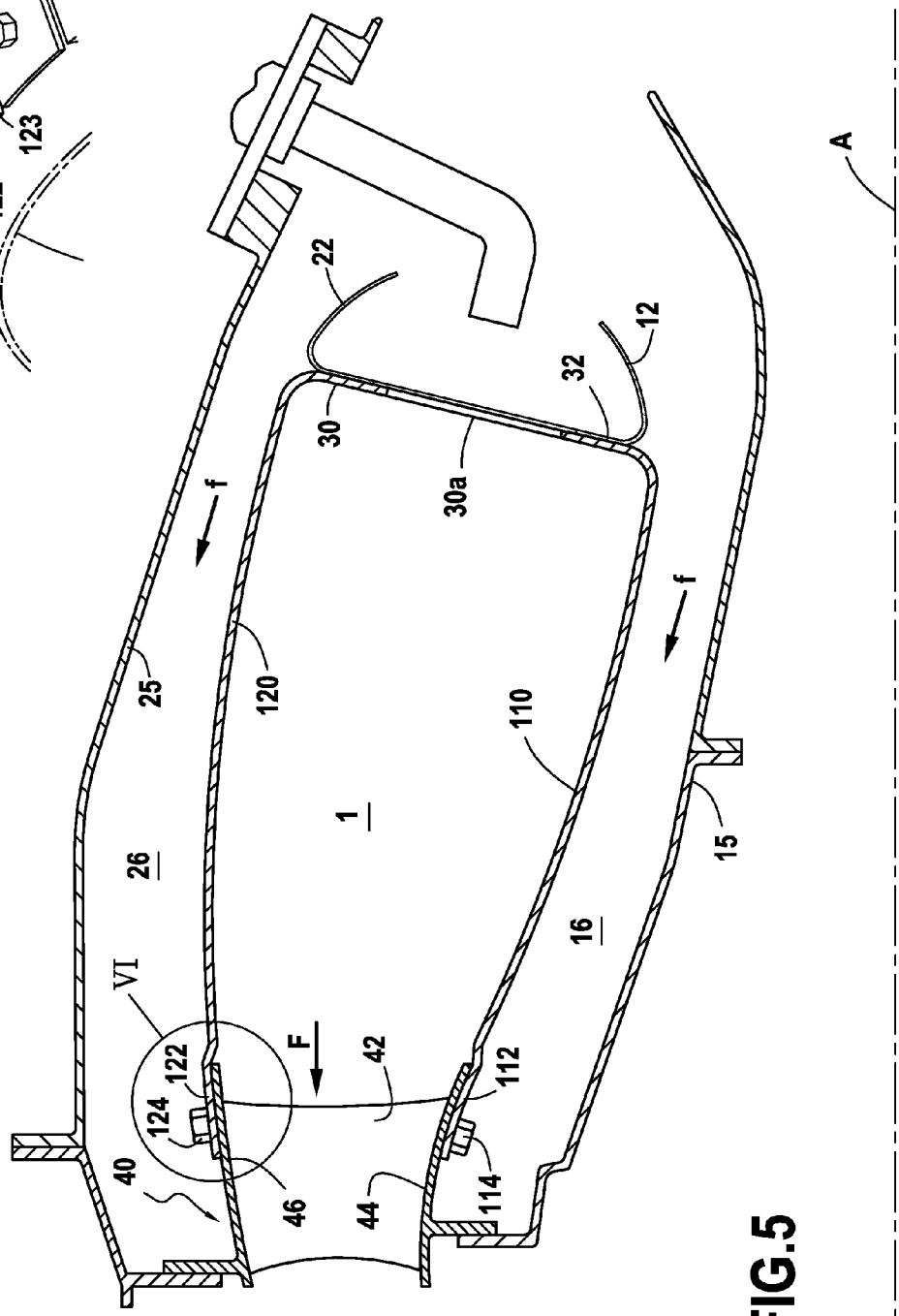
FIG. 5 is a view similar to that of FIG. 3 showing a variant embodiment of the invention.

FIGS. 5 and 6 show a variant embodiment of the connection between the combustion chamber and the HP turbine nozzle 40.

The outer wall sectors 120 are extended downstream by end portions 122 that cover the outer face of the outer annular wall 46 of the nozzle 40. The connection between the end portions 122 and the nozzle 40 is provided by screws 124 that pass through orifices formed in the end portions 122 and that screw into tapped blind holes (for example) that are formed in the wall 46 and in the vanes 42. The connection could also be made by bolting using bolts carried by the wall 46 and passing through the end portions 122. The end portions 122 are of width that is smaller than the width of the remainder of the wall sectors 120 so as to leave gaps 123 between adjacent end portions 122 and thus accommodate differential dimensional variation between the CMC end portions and the metal wall 46 of the nozzle.

Similarly, the inner wall sectors 110 are extended downstream by end portions 112 of smaller thickness that cover the outer face of the inner annular wall 44 of the nozzle 40. The end portions 112 are connected to the nozzle by screws 114, or by bolting, in the same manner as the end portions 122.

What is claimed is:

1. An annular combustion chamber assembly for a gas turbine, the assembly comprising: an inner metal casing; an outer metal casing; an annular combustion chamber mounted between the inner and outer casings and comprising an annular inner wall and an annular outer wall of ceramic material together with a chamber end wall connected to the inner and outer walls and provided with orifices for receiving injectors; and elastically-deformable link parts supporting the combustion chamber between the inner metal casing and the outer metal casing; the assembly formed by the inner wall, the outer wall, and the end wall of the combustion chamber being subdivided circumferentially into adjacent chamber sectors, each comprising an inner wall sector, an outer wall sector, and a chamber end sector interconnecting the outer and inner wall sectors;

wherein each chamber sector is made as a single piece of ceramic composite material, wherein elastically-deformable link parts connect the inner metal casing and the outer metal casing respectively to each inner wall sector of the combustion chamber and to each outer wall sector of the chamber, and wherein a one-piece ring is also provided in contact with the chamber end wall sectors and to which the chamber sectors are connected.

2. An assembly according to claim 1, wherein the connection between the chamber sectors and the ring is made by means of injector bowls.

3. An assembly according to claim 1, further comprising inner and outer annular cowls extending the inner and outer walls of the combustion chamber upstream and carried by said ring.

4. An assembly according to claim 1, wherein each link part has a first end fastened to the inner or outer metal casing and a second end fastened to an inner or outer wall sector of the combustion chamber.

5. An assembly according to claim 4, wherein each inner or outer combustion chamber wall sector carries at least one tab to which the second end of a link part is fastened.

6. An assembly according to claim 5, wherein each tab of an inner or outer combustion chamber wall sector is made of ceramic matrix composite material and is incorporated in the sector during fabrication thereof.

7. An assembly according to claim 6, wherein each tab comprises fiber reinforcement that extends fiber reinforcement of the inner or outer wall sector in which the tab is incorporated.

8. An assembly according to claim 6, wherein each tab comprises fiber reinforcement that is connected to fiber reinforcement of the inner or outer wall sector in which the tab is incorporated.

9. An assembly according to claim 1, wherein a sealing gasket is interposed between adjacent chamber sectors.

10. An assembly according to claim 9, wherein the sealing gasket comprises a fiber structure made of refractory fibers.

11. An assembly according to claim 10, wherein the fiber structure of the sealing gasket is densified at least in part by a ceramic matrix.

12. An assembly according to claim 1, including inner and outer annular sealing lips fastened to the downstream end portion of the chamber on the outsides of the inner and outer chamber walls.

13. An assembly according to claim 12, wherein each inner or outer combustion chamber wall sector carries at least one tab to which the second end of a link part is fastened, and wherein the sealing lips are fastened to the tabs carried by the inner and outer wall sectors of the chamber.

14. An assembly according to claim 1, wherein the inner and outer chamber wall sectors are extended by end portions that are fastened on the outer faces of the inner and outer walls of a turbine nozzle disposed at the outlet from the combustion chamber.

15. A gas turbine aero-engine provided with a combustion chamber assembly according to claim 1.

* * * * *